United States Patent [19]

Landa

[11] 4,392,742

[45] Jul. 12, 1983

[54] LIQUID DEVELOPER COPIER CLEANING SYSTEM INCORPORATING RESILIENT CLOSED-CELL CLEANING ROLLER

[75] Inventor: Benzion Landa, Edmonton, Canada

[73] Assignee: Savin Corporation, Valhalla, N.Y.

[21] Appl. No.: 959,324

[22] Filed: Nov. 9, 1978

[51] Int. Cl.[3] ..... G03G 21/00; G03G 15/10

[52] U.S. Cl. ..... 355/15; 15/256.52; 101/425; 355/10

[58] Field of Search ..... 355/3 R, 15, 10; 15/256.51, 256.52; 101/425

[56] References Cited

U.S. PATENT DOCUMENTS

| | | | |
|---|---|---|---|
| 3,598,487 | 8/1971 | Mizuguchi et al. | 355/15 |
| 3,654,654 | 4/1972 | Abreu et al. | 355/15 X |
| 3,807,853 | 4/1974 | Hudson | 355/15 |
| 3,848,994 | 11/1974 | Fraser | 355/15 |
| 3,900,003 | 8/1975 | Sato et al. | 355/15 X |
| 4,078,924 | 3/1978 | Keddie et al. | 355/15 X |
| 4,080,059 | 3/1978 | Tani et al. | 355/15 |
| 4,101,215 | 7/1978 | Fottner et al. | 355/15 |

FOREIGN PATENT DOCUMENTS

| | | | |
|---|---|---|---|
| 2736078 | 2/1978 | Fed. Rep. of Germany | 355/15 |

*Primary Examiner*—Fred L. Braun

*Attorney, Agent, or Firm*—Shenier & O'Connor

[57] ABSTRACT

A cleaning system for a liquid developer electrophotographic copier includes a roller formed with a body of resilient material, such as a closed-cell elastomer, having externally exposed, internally isolated surface cells. The roller is mounted to extend across the imaging surface in contact therewith and is driven to move the roller surface relative to the wet imaging surface to scrub the imaging surface and concomitantly under the action of the roller surface open cells to draw from the imaging surface liquid carrying toner effectively to dry the imaging surface. A small-radius edge is disposed in trailing engagement with the roller surface to deform the roller material sufficiently from the surface cells to be carried away for reuse or disposal.

2 Claims, 6 Drawing Figures

LIQUID DEVELOPER COPIER CLEANING SYSTEM INCORPORATING RESILIENT CLOSED-CELL CLEANING ROLLER

BACKGROUND OF THE INVENTION

This invention relates to apparatus for cleaning and drying a surface and, in particular, apparatus for cleaning and drying the photoconductive imaging surface of a liquid developer electrophotographic copier.

Electrophotographic copiers of the image transfer type, or plain paper copiers, as they are generally known, are well-known in the art. In one type of image transfer copier the electrostatic image formed by selectively discharging a photoconductive surface is subjected to the action of a liquid developer to form a visible image corresponding to the latent image. The developed image thus formed is then transferred to a sheet of plain paper and the photoconductive surface is then available to be used for a subsequent copying operation. Owing to the fact that the transfer of the developed image between the photoconductive surface and the sheet of plain paper is incomplete, a residual image remains on the photoconductive surface which must be cleaned before being reused. In copiers of the type which employ liquid developers it is not only necessary that the toner particles remaining after transfer be removed but also the surface of the drum should be wiped as dry as possible prior to the next copying operation. Cleaning arrangements heretofore employed in liquid developer electrostatic copiers typically employ a two-step operation in which the photoconductive surface is first moved past a wetted spongy roller formed of open-cell material to scrub residual toner particles from the surface and is then moved past an elongated squeegee blade to wipe the surface dry. While this and similar arrangements satisfactorily clean the photoconductive surface, the two-step nature of the cleaning and drying operation introduces an undesirable complexity into the design of the system. Further, the abrasion of the photoconductive surface due to the action of the roller and blade typically used, while initially small, is nevertheless appreciable and over a long period of time will degrade the image reproducing capability of the photoconductive surface. The open-cell foam roller tends to soak up cleaning liquid, resulting in objectionable fumes as the liquid evaporates. In addition, buildup of toner particles on the roller and blade as time passes increase the abrasive action of these elements on the photoconductive surface.

U.S. Pat. No. 3,807,853, issued to F. W. Hudson, discloses a cleaning apparatus for a dry developer electrophotographic copier in which a roller formed from open-cell or closed-cell material which preferably is polyurethane is driven in frictional engagement with the photoconductive surface sufficient impact to sweep remaining dry developer toner particles therefrom. The roller surface then moves past a doctor blade which abrades against the roller surface with sufficient force to enter the cellular structure and scrape the toner particles therefrom.

While the patentee speaks in passing near the end of the specification of using the roller in conjunction with marking materials such as "inks", it is abundantly clear from the disclosure that the patentee contemplates only removal of dry particles from the surface of the photoconductor. To this end to remove the dry trapped toner particles from the roller cells, the patentee orients the scraper blade with its knife edge digging sharply into the roller surface against the direction of motion thereof so that the blade in effect scoops the particles out of the cells by entering the same. This orientation of the scraper blade, while necessary for removal of dry powder from the roll cells obviously, is highly abrasive and results in a very short useful life of the roller. This problem is aggravated by the fact that the patentee prefers a roller formed of relatively soft and nonabrading material so as not to damage the imaging surface itself.

Even with this highly abrasive method of removing the trapped toner particles from the surface cells of the roller, the purely mechanical method contemplated cannot ensure complete evacuation of the surface cells. As a result, the roller will sweep residual toner particles past the imaging surface on subsequent rotation, damaging the imaging surface over a long period of time.

Finally, if the roller of open-cell material described by the patentee as one of the two equivalent materials were to be used in a liquid developer copier, either the surface would not be dry in the absence of a wiper blade or, if a wiper blade is used, the system would involve the same defects as do systems of the prior art. Moreover, if the open-cell roller and scraper blade of Hudson were used in a liquid developer machine the scraper blade would be ineffective to remove either toner liquid or trapped toner particles from the interior cells of the roller and would thus not avoid the previously noted problems of clogging or fume emission.

SUMMARY OF THE INVENTION

One of the objects of my invention is to provide a mechanically simple apparatus for cleaning and drying a wet surface.

Another object of my invention is to provide a cleaning apparatus which is especially suitable for use in a liquid developer electrophotographic copier.

Still another object of my invention is to provide a liquid developer cleaning apparatus in which a single roller in contact with the imaging surface performs both functions of cleaning and drying the surface.

A further object of my invention is to provide a cleaning apparatus which does not degrade the imaging surface of an electrophotographic copier even over a long period of time.

Still another object of my invention is to provide a cleaning apparatus which resists clogging.

Yet another object of my invention is to provide a cleaning apparatus which minimizes the emission of objectionable fumes during periods of nonuse.

Other and further objects of my invention will be apparent from the following description.

In general, my invention contemplates a cleaning roller formed with a resilient body having externally exposed, internally isolated surface cells. Preferably, the body is formed from a closed-cell elastomer. The roller is mounted across the imaging surface at the cleaning station and is so driven as to move the roller surface relative to the imaging surface in the region of contact therebetween to scrub the imaging surface and under the action of the roller surface open cells to draw from the imaging surface liquid carrying toner effectively to dry the imaging surface. A small-radius edge is disposed in trailing engagement with the roller surface to deform the roller material to remove liquid from the surface cells for reuse or disposal. Cleaning liquid is supplied to the surface of the roller at a suitable point between the imaging surface and the small-radius edge to flush solid toner deposits from the surface cells to ensure that the cells are completely cleaned.

In operation of my apparatus liquid on the imaging surface approaching the nip between the surface and the cleaning roll fills the cells, thus effectively removing the liquid carrying entrained toner particles from the imaging surface. When the exposed cells reach the small-radius edge, the roller body material is compressed to squeeze the liquid from the cells, leaving the roller substantially dry. I am thus able actually to convey the liquid off the imaging surface rather than simply diverting the liquid, as do static squeegee blades, for example. In addition, my roller has the advantage over such static blades that it is self-cleaning.

Further, while also serving as a scrubbing member, my cleaning roller exhibits exceptionally low abrasiveness in its scrubbing contact with the imaging surface. While no completely satisfactory explanation for this low abrasiveness is yet known, it is believed that the surface tension in the exposed outer cells prevents the displacement of liquid from adjacent areas, thus maintaining an extremely thin film between the roller material and the drum surface. The only effective requirement is that the nip area with the imaging surface be wet.

Moreover, because the small-radius blade need not have a sharp edge and merely depresses the roller at the point of contact rather than digging into it with a scooping action, damage to the roller surface itself is minimized. Finally, unlike spongy-surfaced, or open-celled, cleaning rollers of the prior art, my cleaning roller does not soak up cleaning liquid with the resulting clogging and emission of fumes when the liquid eventually evaporates. Neither does my roller accumulate toner particles over a period of time.

BRIEF DESCRIPTION OF THE DRAWINGS

In the accompanying drawings to which reference is made in the instant specification and in which like reference characters are used to indicate like parts in the various views.

DETAILED DESCRIPTION OF THE PREFERRED EMBODIMENTS

Figure 1:
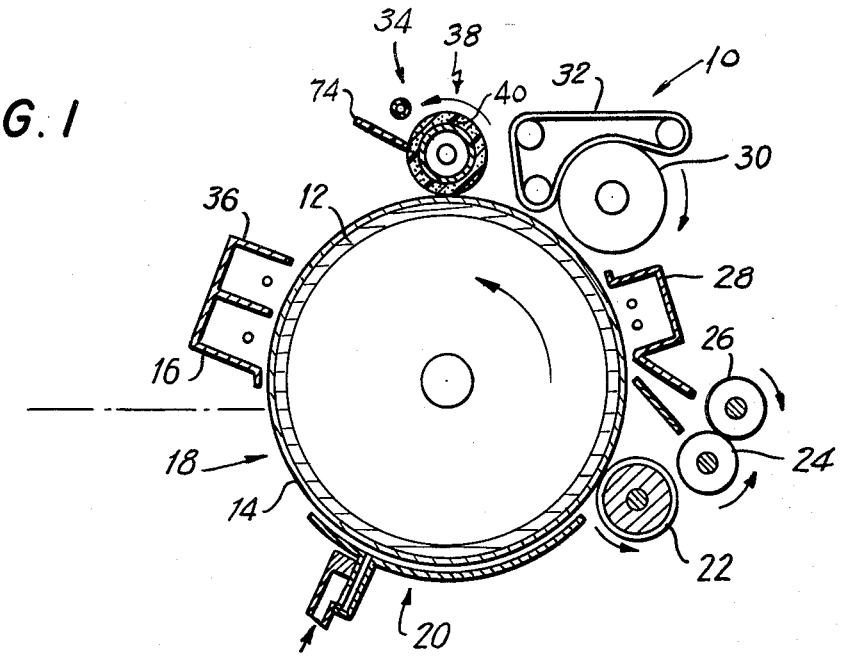
FIG. 1 is a side elevation of an electrophotographic copier incorporating my cleaning apparatus, with parts shown in section.

Referring first to FIG. 1, an electrophotographic copier in which my apparatus may be used, indicated generally by the reference numeral 10, includes a cylindrical drum 12 having an outer surface 14 formed of a suitable photoconductor such as selenium. In use of the copier 10, the surface 14 of the drum 12 is moved successively past a corona charger 16 which provides the surface 14 with a uniform electrostatic charge, an exposure station 18 at which the drum surface 14 is exposed to a light image of an original to selectively discharge the surface to form an electrostatic latent image, and a developing station 20 at which a liquid developer is applied to the drum surface to form a developed toner image. A metering roller 22 spaced slightly from the drum surface 14 immediately beyond the developing station 20 is rotated at a high speed in a reverse direction to remove excess developer liquid from the drum surface portion bearing the developed image.

Following the metering roller 22, the developed image is transferred to a sheet of plain copy paper (not shown) fed between a pair of rollers 24 and 26 to the surface 14 of the drum 12 beneath a transfer corona 28, which charges the copy paper with such a polarity as to attract the toner image electrostatically from the surface of the drum. The paper bearing the transferred image then is separated from the drum 12 by any suitable means (not shown) to pass between a turnaround roller 30 and a turnaround belt 32 trained around a portion of the roller. Finally, the drum surface passes through a cleaning station, indicated generally by the reference numeral 34, where the surface is cleaned of any remaining toner particles, and past a discharge corona 36, which dissipates any remaining electrostatic charge on the surface of the drum 12. As is known in the art selenium is notoriously susceptible to abrasion damage.

Figure 4:
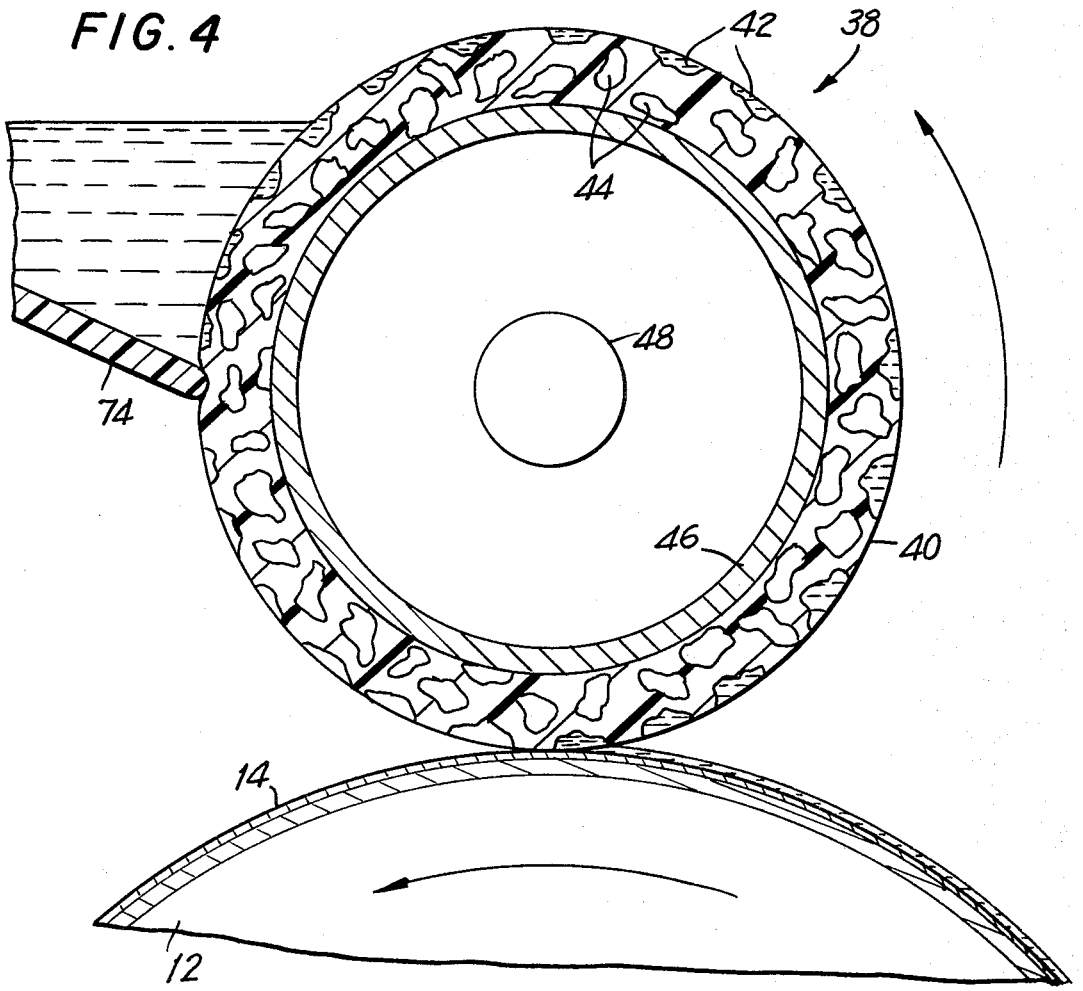
FIG. 4 is an enlarged section of the cleaning roller shown in FIG. 2, with certain features illustrated on an exaggerated scale.
Figure 2:
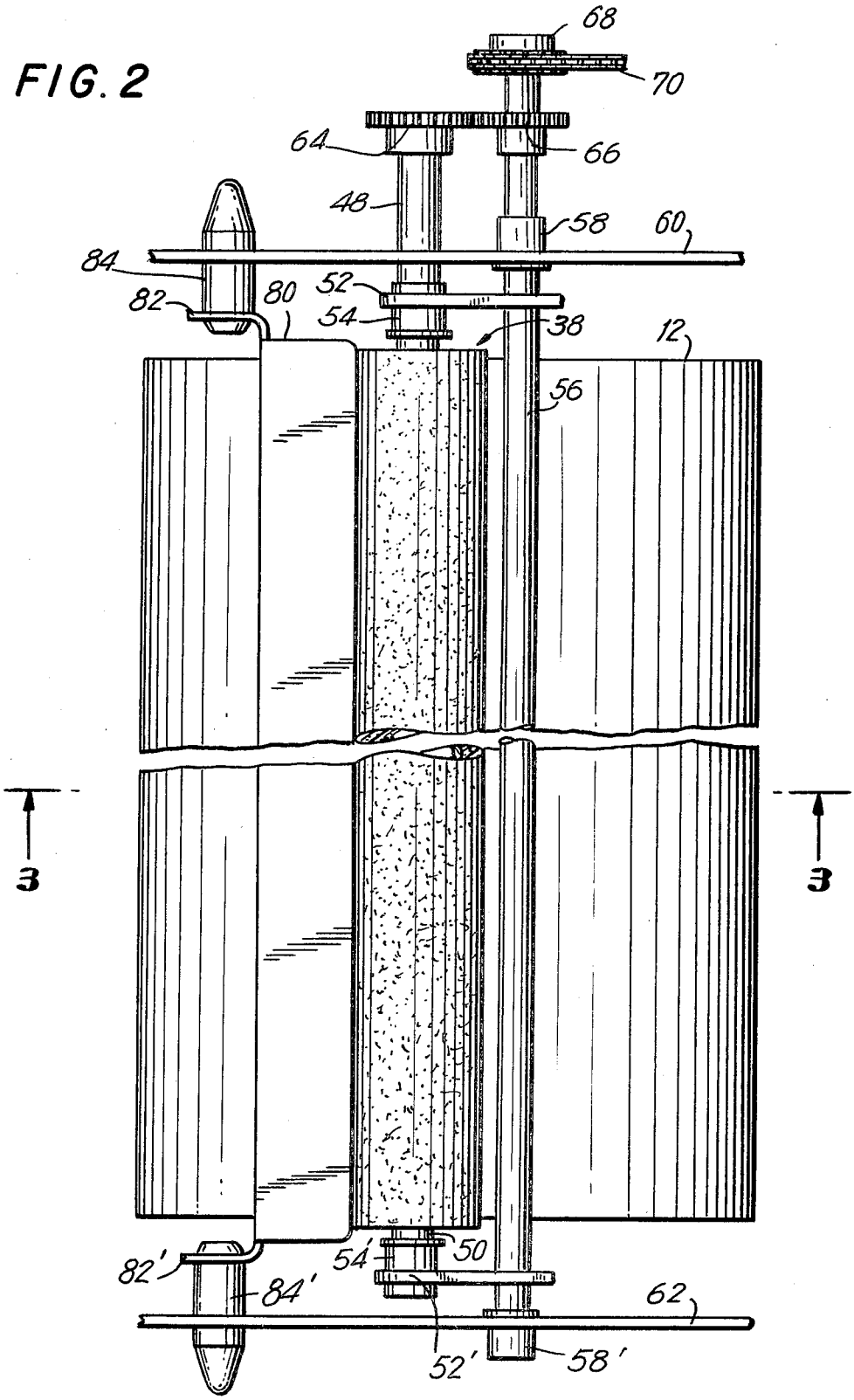
FIG. 2 is an enlarged top plan of the cleaning apparatus of the copier shown in FIG. 1.
Figure 3:
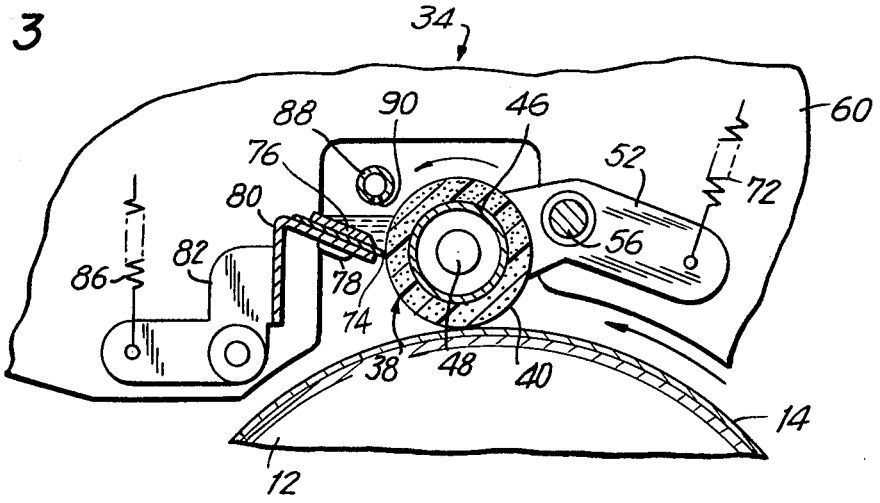
FIG. 3 is a fragmentary section of the cleaning apparatus shown in FIG. 2.

Referring now to FIGS. 2 and 4, my cleaning apparatus at station 34 includes a roller, indicated generally by the reference numeral 38, having a body 40 of resilient material formed with externally exposed surface cells 42 isolated from all interior cells 44 which may be present in the body 40. Preferably, I provide the desired cellular surface configuration by grinding, cutting with a taut hot wire or the like, a closed-cell elastomer such as polyethylene or neoprene. While the resilient material inherently contains interior cells 44, these cells are hermetically isolated from the surface of the outer layer 40 and, apart from their effect on the bulk resilience, play no direct role in the operation of my invention. Outer layer 40 is assembled on a metal cylindrical core 46 provided with coaxial stub shafts 48 and 50.

Respective bell cranks 52 and 52' rotatably receive shaft 48 and shaft 50 in suitable bearings 54 and 54'. Cranks 52 and 52' are rotatably mounted on a shaft 56 rotatably received in bearings 58 and 58' carried by respective frame portions 60 and 62. Shafts 48 and 56 extend past frame portion 60 to receive respective intermeshing gears 64 and 66. A further extension of shaft 56 receives a sprocket wheel 68 coupled by a drive chain 70 to a suitable driving source as a motor (not shown). Finally, I couple the other arm of each of the bell cranks 52 and 52' to one end of a tension spring 72. Springs 72 resiliently bias roller 38 against the electrophotographic surface of the drum 12. Drive chain 70 drives roller 38 to a peripheral velocity about equal to that of the surface of the drum 12, but opposite in direction, to scrub the drum surface to ensure that all toner particles are removed together with the carrier liquid.

I resiliently urge the edge of a wiper blade 74 against the roller 38 at a point spaced from the drum 12. I secure the wiper blade 74 by means of a retainer strip 76 and screws 78 to an elongated V-shaped bracket 80, the ends of which are extended to form bell cranks 82 and 82'. Cranks 82 and 82' are rotatably mounted on the respective frame portions 60 and 62 through suitable pins 84 and 84'. I attach the other arm of each of the bell cranks 82 and 82' to one end of a respective spring 86, which resiliently urges the blade 74 into edge engagement with the outer surface of the roller 38. Blade 74 extends upwardly away from the roller surface to form a trough to which I supply cleaning liquid by means of a transversely extending conduit 88 having orifices 90 disposed along the underside thereof. Blade 74 may comprise any suitable material such as sheet metal, polyvinyl chloride or metallized polyester. Preferably, the radius of curvature of the contacting edge portion of the blade 74 should be as small as possible so as to be comparable with the cell size of the material 40. It will readily be appreciated that the angle of blade 74 to the surface of body 40, considering the direction of rotation of roller 38 indicated in the drawings, is such that the blade edge "drags" on the surface rather than biting into it against its rotary movement. Thus, while the blade deforms the body sufficiently to empty the surface cells 42, its action is not such as will severly abrade the body surface. In this connection it is to be noted that the blade need not scrape the bottoms of the cells. It need only deform the body material sufficiently to squeeze the liquid out of the cells. Conduit 90 supplies sufficient liquid to ensure that all toner particles are easily carried away.

In normal operation, the wiper blade 74 deforms the surface cells 42 to remove most of the trapped liquid therefrom. As the cells 42 leave the nip area with the drum surface 14, they carry the liquid and toner particles entrained therein. The compressed nip area with the drum surface 14 resulting from the resilient biasing force enhances the trapping of liquid, since the surface cells 42 expand somewhat as they leave the nip area. Dry contact between roller 38 and surface 14 when the copier 10 is actuated after an idle period may be avoided either by directly irrigating the nip between the roller 38 and surface 14 or by retracting the roller 38 from the drum surface when the copier is not in use and engaging the roller 38 only when the drum surface portion initially at the developing station has advanced to the cleaning station 34.

Figure 5:
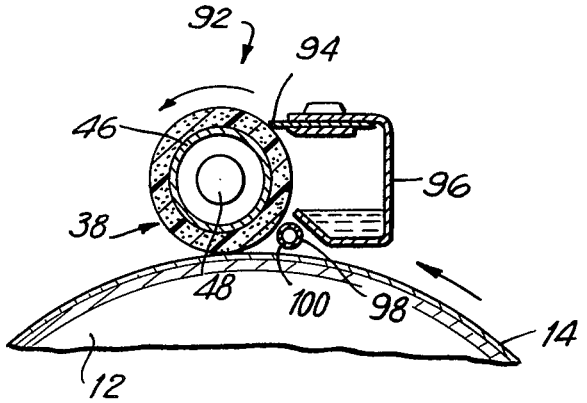
FIG. 5 is a fragmentary section of an alternative embodiment of my cleaning apparatus.

In FIG. 5, I show an alternative assembly, indicated generally by the reference numeral 92, in which a blade 94 mounted at the top of a generally C-shaped trough 96 engages the roller 38 at a "leading" location, or location ahead of the top of the roller with reference to the direction of rotation thereof. Trough 96 is positioned to collect liquid and entrained toner particles removed from roller 38 by blade 94. A transversely extending conduit 98 having orifices 100 provides cleaning liquid to the nip formed by roller 38 and drum 12 from the leading side. The counterclockwise rotating action of roller 38 carries the cleaning liquid up the righthand side of roller 38, as viewed in FIG. 5, to the wiper blade 94, which directs it downwardly into the trough 96, which carries the liquid and entrained toner particles away from the cleaning station.

Figure 6:
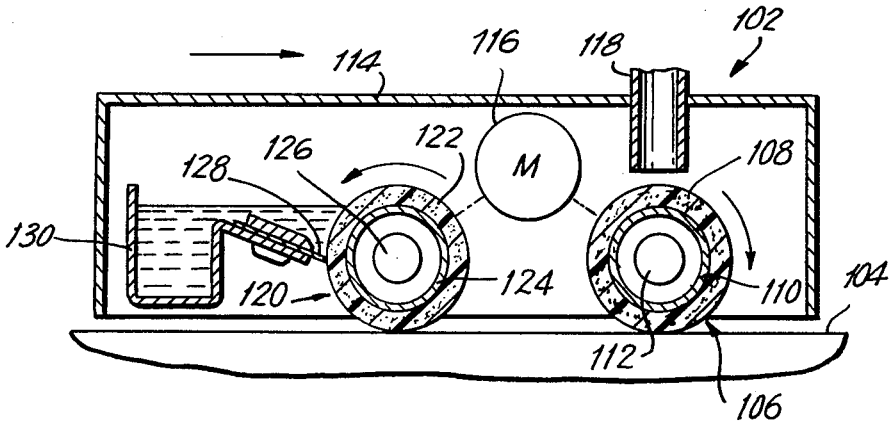
FIG. 6 is a fragmentary section illustrating the use of the cleaning roller of my apparatus as a drying roller in a floor cleaner.

While my roller 38 has special utility in a liquid developer copying machine incorporating a photosensitive material which is prone to damage by abrasion, its superior drying ability makes it generally useful in cleaning apparatus such as the type shown in FIG. 6. This cleaning apparatus, indicated generally by the reference numeral 102, may be used to clean a stationary surface 104 such as a floor. In the apparatus 102, a cleaning roller indicated generally by the reference numeral 106 comprises a body 108 of a suitable material such as open-cell foam formed around a cylindrical core 110. Core 110 is coaxial with stub shafts 112 rotatably received by a housing 114 and coupled to a motor 116 for rotation relative to the surface 104. While I have shown the roller 106 rotating in a clockwise direction in FIG. 6, the direction of rotation is not critical. I supply a suitable cleaning liquid such as soap and water to the roller 106 by any suitable means such as a conduit 118. A sealing roller 120 has a body 122 of preferably closed-cell material similar to the material of roller 38 formed around a cylindrical core 124. Core 124 in turn extends coaxially with stub shafts 126 rotatably received by the housing 114 and coupled by suitable means (not shown) to the motor 116.

In use the apparatus 102 is moved, manually or otherwise, relative to the surface 104 in such a direction that the cleaning roller 106 is the first roller to contact the surface portions being cleaned. The rotation of the roller 106 scrubs the surface 104 in a conventional manner. Any liquid that remains on the surface 104 is picked up by the sealing roller 120 and is carried upwardly around to a wiper blade 128 disposed in edge engagement with the roller 120. The cleaning liquid picked up in this manner is then directed into a trough 130 to which the wiper blade 128 is attached. The action of blade 128 is the same as that of blades 74 and 94 described hereinabove.

It will be seen that I have accomplished the objects of my invention. My cleaning apparatus satisfactorily cleans and dries the imaging surface of a liquid developer electrophotographic copier using only a single active member. My cleaning apparatus does not degrade the imaging surface even over a long period of time. My cleaning apparatus does not absorb cleaning liquid and therefore does not emit excessive fumes or become clogged as the liquid evaporates.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. Apparatus for removing liquid from a wet surface including in combination a roller comprising a body of resilient material formed with cells over the surface of said roller which are open to the external environment and isolated from the interior of said body, means mounting said roller with the surface of said body in engagement with said wet surface, means for rotating said roller to cause the action of said surface cells to remove liquid from said wet surface, and means remote from said wet surface for deforming said surface cells to force the liquid therefrom, said deforming means having an edge in contact with said roller, said edge having a radius of curvature comparable with the size of said surface cells.

2. Apparatus for removing liquid from a wet surface including in combination a roller comprising a body of resilient material formed with cells over the surface of said roller which are open to the external environment and isolated from the interior of said body, means mounting said roller with the surface of said body in engagement with said wet surface, means for rotating said roller to cause the action of said surface cells to remove liquid from said wet surface, and means remote from said wet surface for deforming said surface cells to force the liquid therefrom, said deforming means being formed with a relatively flat leading surface portion having a relatively rounded edge in contact with said roller, the radius of curvature of said edge being comparable with the size of said surface cells, said relatively flat surface portion being so arranged as to extend rearwardly away from said roller surface with reference to the direction of rotation thereof.

* * * * *